US007258843B2

(12) United States Patent
Brück et al.

(10) Patent No.: US 7,258,843 B2
(45) Date of Patent: Aug. 21, 2007

(54) ASSEMBLY HAVING A HONEYCOMB BODY AND A SHORTENED, SLIT, INNER CASING TUBE

(75) Inventors: Rolf Brück, Bergisch Gladbach (DE); Jörg-Roman Konieczny, Siegburg (DE); Katrin Schaper, Troisdorf (DE); Wolfgang Maus, Bergisch Gladbach (DE)

(73) Assignee: Emitec Gesellschaft fuer Emissionstechnologie GmbH, Lohmar (DE)

( * ) Notice: Subject to any disclaimer, the term of this patent is extended or adjusted under 35 U.S.C. 154(b) by 880 days.

(21) Appl. No.: 10/378,245

(22) Filed: Mar. 3, 2003

(65) Prior Publication Data

US 2003/0147782 A1 Aug. 7, 2003

Related U.S. Application Data

(63) Continuation of application No. PCT/EP01/10052, filed on Aug. 31, 2001.

(30) Foreign Application Priority Data

Sep. 13, 2000 (DE) ..... 100 45 540

(51) Int. Cl.
*B01D 50/34* (2006.01)
*B01D 50/00* (2006.01)
*B01J 8/02* (2006.01)

(52) U.S. Cl. ..... 422/180; 422/179; 422/221; 422/222; 422/181

(58) Field of Classification Search ..... 422/179, 422/122, 180

See application file for complete search history.

(56) References Cited

U.S. PATENT DOCUMENTS 4,948,353 A 8/1990 Maus et al. ..... 422/180
5,079,210 A 1/1992 Kaji et al. ..... 60/299

(Continued)

FOREIGN PATENT DOCUMENTS

DE 39 30 680 A1 3/1991

(Continued)

*Primary Examiner*—Glenn Caldarola
*Assistant Examiner*—Kaity Handal
(74) *Attorney, Agent, or Firm*—Laurence A. Greenburg; Werner H. Stemer; Ralph E. Locher

(57) ABSTRACT

An assembly includes a honeycomb body secured by an inner casing tube in a housing, in particular a housing of an exhaust system of an internal combustion engine. The inner casing tube has an overall length which is bounded axially by two edges and is substantially smaller than the axial length of the honeycomb body. The inner casing tube is also disposed in an approximately axially central position around the honeycomb body and is connected, in particular brazed, thereto in at least one axial connection region. The inner casing tube has a region within the axial connection region in which it is connected to the honeycomb body on the inside or attached directly adjacent the latter on the outside and is connected to the housing. Regions of the inner casing tube which are not connected to the housing but are connected to the honeycomb body toward the inside are constructed as radially elastic spring elements. In this way, a resilient attachment, which adapts to deformations of the honeycomb body, is produced without tearing. That is advantageous in particular in the case of honeycomb bodies made of very thin sheet-metal layers, in particular thinner than 0.03 mm.

24 Claims, 4 Drawing Sheets

U.S. PATENT DOCUMENTS

| | | | | |
|---|---|---|---|---|
| 5,118,476 | A * | 6/1992 | Dryer et al. | 422/179 |
| 6,562,305 | B1 * | 5/2003 | Swars et al. | 422/174 |

FOREIGN PATENT DOCUMENTS

| | | |
|---|---|---|
| DE | 197 43 196 A1 | 4/1999 |
| EP | 0 631 815 A1 | 1/1995 |
| JP | 3-157 139 | 7/1991 |
| JP | 7-208 157 | 8/1995 |
| JP | 08 294 632 | 11/1996 |
| JP | 10 000 337 | 1/1998 |

* cited by examiner

ASSEMBLY HAVING A HONEYCOMB BODY AND A SHORTENED, SLIT, INNER CASING TUBE

CROSS-REFERENCE TO RELATED APPLICATION

This application is a continuation of copending International Application No. PCT/EP01/10052, filed Aug. 31, 2001, which designated the United States and was not published in English.

BACKGROUND OF THE INVENTION

FIELD OF THE INVENTION

The invention relates to an assembly including a honeycomb body secured by an inner casing tube in a housing, in particular a housing of an exhaust system of an internal combustion engine. The inner casing tube has an overall length which is bounded axially by two edges and is substantially smaller than the axial length of the honeycomb body. The inner casing tube is also disposed in an approximately axially central position around the honeycomb body and is connected thereto by a joining technique, in particular by brazing, in at least one axial connection region. Such honeycomb bodies are used in particular in the manufacture of motor vehicles for cleaning an exhaust gas generated by an internal combustion engine.

A honeycomb body with such an attachment is known, for example from U.S. Pat. No. 4,948,353. Japanese Patent Publication JP 8-294 632 also discloses a similar attachment. The cylindrical honeycomb body described in that publication is constructed from smooth, corrugated metal sheets and surrounded by a cylindrical casing. The casing has slits distributed over its periphery which start from an end surface of the casing. The honeycomb body with the casing is oriented therein in such a way that the slits face away from the exhaust gas inlet side during the process of cleaning the exhaust gas. The honeycomb body is connected to the casing only in the region of the slits. On the opposite side, that is to say the exhaust gas inlet side, the casing is connected to a cylindrical housing which is located coaxially outside it.

Investigations into the behavior of such a honeycomb body under changing thermal conditions have shown that the honeycomb body shrinks radially, in particular near its end sides. When that happens, stresses may occur in the connection region between the honeycomb body and the casing, which make it more difficult to permanently connect the honeycomb body to the casing. In particular, honeycomb bodies made of very thin metal sheets, for example thinner than 0.03 mm or even than 0.025 mm, assume a barrel-like shape. The central region maintains its original diameter but the end sides having a smaller diameter.

SUMMARY OF THE INVENTION

It is accordingly an object of the invention to provide an assembly having a honeycomb body and a shortened, slit, inner casing tube, which overcomes the hereinafore-mentioned disadvantages of the heretofore-known devices of this general type and which provides an attachment of the honeycomb body in a housing that is adapted in particular to the described behavior of the honeycomb body at changing temperatures, and thus ensures permanent fixing of the honeycomb body in the housing.

With the foregoing and other objects in view there is provided, in accordance with the invention, an assembly, comprising a housing, in particular a housing of an exhaust system of an internal combustion engine, a honeycomb body having a given axial length and an inner casing tube securing the honeycomb body in the housing. The inner casing tube substantially axially centrally surrounds the honeycomb body and is joined to the honeycomb body by a joining technique, in particular by brazing, sintering or welding, in at least one axial connection region. The inner casing tube has two edges and an overall length substantially smaller than the given axial length. The overall length is bounded axially by the edges. The inner casing tube has a partial region within the axial connection region. The inner casing tube is connected to the honeycomb body on the inside or is attached directly adjacent the honeycomb body on the outside, in the axial connection region. The inner casing tube is connected to the housing in the partial region. The inner casing tube has regions acting as radially elastic spring elements. The regions are inwardly connected to the honeycomb body but are not connected to the housing.

The assembly having the attachment according to the invention is constructed in such a way that the spring elements can follow the deformation of the honeycomb body without tearing away, and at the same time the connection of the inner casing tube to the housing is made in the region in which the diameter of the honeycomb body only changes to a small degree.

A shorter length of the inner casing tube with respect to the honeycomb body has the advantage of not impeding the movement of particularly highly shrinking regions of the honeycomb body (for example near the end sides). In addition, a thermally insulating gap is formed around these regions and this has a positive influence in particular on the heating behavior of the honeycomb body. That is because the thermal energy which is introduced at the end sides cannot be carried away at these regions to an inner casing tube surrounding the honeycomb body.

The spring elements can preferably be formed by slits and be bounded in the circumferential direction, enabling almost any desired degree of elasticity to be set, depending on the dimensioning of the slits.

In particular, in the case of honeycomb bodies made of very thin metal sheets in exhaust gas systems of motor vehicles, it has been surprisingly found in trials that they are subject to considerable stresses due to deformation, not only on the gas inlet side but also on the gas outlet side. During the heating of such a honeycomb body by an exhaust gas, primarily through the gas inlet side, the honeycomb body cools simultaneously from both end sides. This leads to increased radial shrinkage of the honeycomb body near the end sides in comparison with other regions. The inner casing tube, in conjunction with the slits, forms segments which behave similarly to bending springs. This means that these bending springs can at least radially follow the thermally-induced expansion or shrinkage of the honeycomb body if they are in contact with the honeycomb body. Thermal stresses between the honeycomb body and the inner casing tube can be significantly reduced in this way. For this reason, it is very advantageous to form spring elements toward both sides.

According to yet another embodiment, the entire honeycomb body with a securing element is disposed approximately symmetrically to a center plane. In this way, the inner casing tube is given a substantially symmetrical construction, as a result of which in particular the mounting of such an attachment is made simpler. In addition, such a symmetrical configuration corresponds to the substantially symmetrical deformation of the honeycomb body during cooling.

The slits have at least one end region, a slit width and a slit length and they at least partially bound a spring element of the inner casing tube in such a way that the spring element can be deflected at least radially. This ensures a reduction in the thermally induced stresses which can arise due to a different thermal expansion behavior of the inner casing tube and the honeycomb body. In this case it is particularly advantageous that the width of a slit is at least 1 mm and preferably at least 2 mm. This ensures that the spring elements do not adversely affect one another even in the case of a relatively strong deformation.

According to a further advantageous embodiment of the invention, the width of a slit varies over the length of the slit. For example, the width of a slit can increase from one end region starting in the direction of the slit. In this way, the torsional strength of the spring element can be set precisely as a function of the thermal stresses of the attachment. The slits can also extend at least partially in the circumferential direction of the inner casing tube. This means that the slits are not exclusively straight but rather can have a corrugated or sinusoidal shape, for example.

It is also particularly advantageous for the slits to have a cutout in at least one end region. In this case, the cutouts are constructed in such a way that the formation of notches in the end region of the slits is prevented.

According to a further embodiment of the invention, at least some of the spring elements each have at least one transverse slit. The transverse slit runs substantially parallel to the edge of the inner casing tube. The transverse slits serve to set a specific torsional strength of the spring element. In this case, a relatively large number and/or a relatively large length of the transverse slits in a spring element brings about a lower torsional strength, as a result of which radial deflection already occurs due to lower forces. In this case, it is likewise particularly advantageous to provide the transverse slits with a rounded portion in at least one end section, as a result of which the formation of notches due to high dynamic loading is avoided.

In a further embodiment of the invention, the honeycomb body has sheet-metal layers which are structured in such a way that they have channels through which an exhaust gas can flow. In this case, the honeycomb body has, in particular, at least a channel density of 800 cpsi (cells per square inch). The sheet-metal layers are constructed with metal sheets which have a sheet-metal thickness of preferably less than 0.03 mm, in particular less than 0.025 mm. Such a honeycomb body is very suitable as a carrier element for a catalytically active coating due to its surface which is very large in relation to its volume. This ensures that an exhaust gas which flows past is provided with a sufficiently catalytically active surface, as a result of which the conversion of pollutants in the exhaust gas is particularly effective. The small sheet-metal thicknesses, preferably less that 0.025 mm, have a very small surface-specific thermal capacitance. The result of this is that after a cold start the honeycomb body very quickly reaches a temperature which is required for catalytic conversion of the pollutants in the exhaust gas.

The connection of the inner casing tube to the housing can be made in various ways, which is explained in more detail with reference to the drawings. The important factor in this case is that the inner casing tube cannot come loose, but the connection between the housing and the inner casing tube does not adversely affect the elasticity of the inner casing tube outside the region in which the connection to the house is made.

Other features which are considered as characteristic for the invention are set forth in the appended claims.

Although the invention is illustrated and described herein as embodied in an assembly having a honeycomb body and a shortened, slit, inner casing tube, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
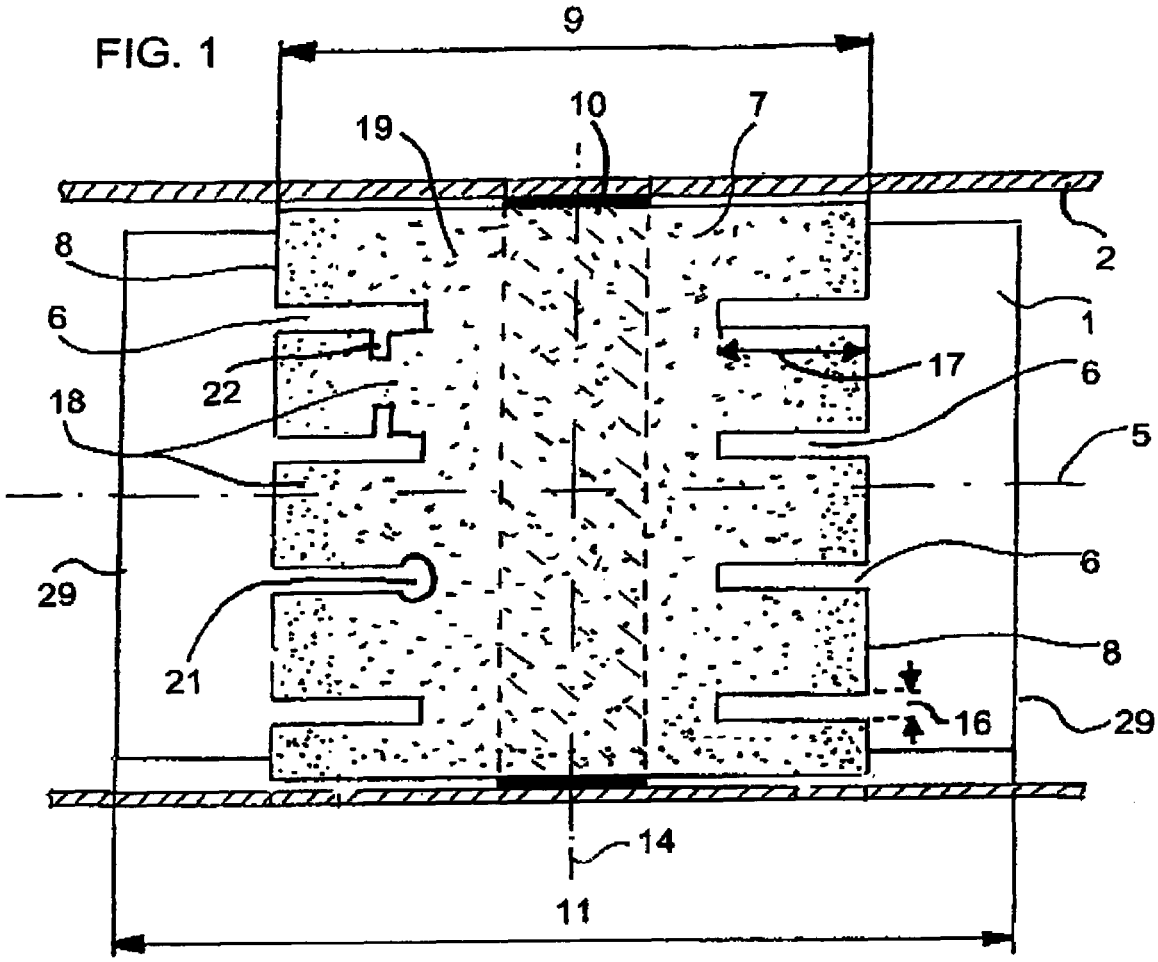
FIG. 1 is a fragmentary, diagrammatic, partly-sectional, side-elevational view of an embodiment of a honeycomb body according to the invention with a housing having longitudinal slits.
Figure 2:
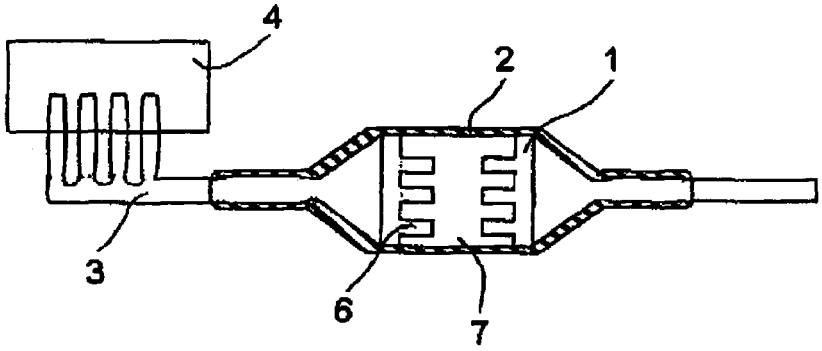
FIG. 2 is a reduced, elevational view of a configuration of an internal combustion engine with an exhaust gas system.

Referring now to the figures of the drawings in detail and first, particularly, to FIGS. 1 and 2 thereof, there is seen an exemplary embodiment of a honeycomb body 1 according to the invention in a housing 2 of an exhaust gas system 3 of an internal combustion engine 4. The honeycomb body 1 and an inner casing tube 7 are disposed coaxially in the housing. The inner casing tube 7 has slits 6 extending substantially along a center axis 5 and has an overall length 9 which is bounded axially by two edges 8. The center axis 5 signifies that the honeycomb body is formed substantially rotationally symmetrically or with an oval or elliptical cross section. An outer side of the inner casing tube 7 is connected directly or indirectly to the housing 2 in at least one partial region 10 (indicated by hatching) which is smaller in the axial direction than the overall length 9. The honeycomb body 1 has an axial honeycomb body length 11 which is bounded by end sides 29. A connecting region 19 (indicated by dots) of the honeycomb body 1 is connected to the inside of the inner casing tube 7. Regions of the inner casing tube 7 which are not connected to the housing 2, but rather to the honeycomb body 1, are constructed as radially elastic spring elements 18. This permits almost unimpeded expansion or shrinkage of the honeycomb body 1 during alternating thermal loading. The spring elements 18 are bounded by the slits 6 which are preferably disposed symmetrically with respect to a center plane 14 of the inner casing tube 7. This supports the shrinkage of the honeycomb body 1 which occurs substantially symmetrically, under operating conditions that ultimately lead to a barrel-like shape in which the central region only changes very little.

In this case, the slits 6 are disposed outside the center plane 14 and extend as far as the edges 8 of the inner casing tube 7 in this exemplary embodiment. The slits 6 have a width 16 of at least 1 mm and preferably at least 2 mm. The width 16 of the slits 6 varies over a length 17 of the slits. The slits 6 have end regions and a recess 21 at least at one of the end regions. At least some of the slits 6 each have at least one transverse slit 22.

The diagrammatic view of FIG. 2 shows the structure of an internal combustion engine 4 with an exhaust gas system 3. The exhaust gas generated in the internal combustion engine 4 is directed into the surroundings through the exhaust gas system. Components for cleaning the exhaust gas are disposed in the housing 2 of the exhaust gas system 3. In this case, FIG. 2 shows an example of a honeycomb body which is secured in the housing 2 through the use of the inner casing tube 7 having the slits 6.

FIGS. 3 to 8 show various possible ways of forming an attachment between the inner casing tube 7 and the housing 2. In this case, very different attachment possibilities can be applied, which have in common the fact that they do not significantly adversely affect the elasticity of the inner casing tube 7 in the off-center region.

Figure 3:
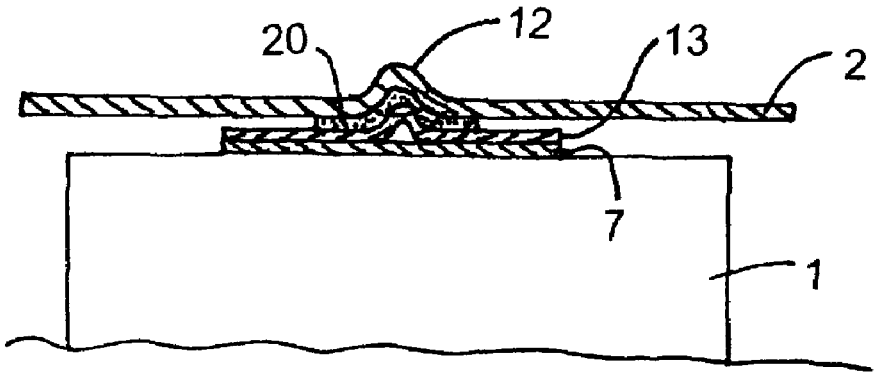
FIGS. 3 to 8 are fragmentary, partly-sectional, side-elevational views of embodiments of attachments of an inner casing tube in a housing.

FIG. 3 shows a form-locking connection in which the inner casing tube 7 is secured in a bead 12 of the housing 2 through the use of an intermediate element 13. In order to avoid vibrations, a swelling mat 20 or a material such as mica can preferably be introduced as an intermediate layer. A form-locking connection is one which connects two elements together due to the shape of the elements themselves, as opposed to a force-locking connection, which locks the elements together by force external to the elements.

Figure 4:
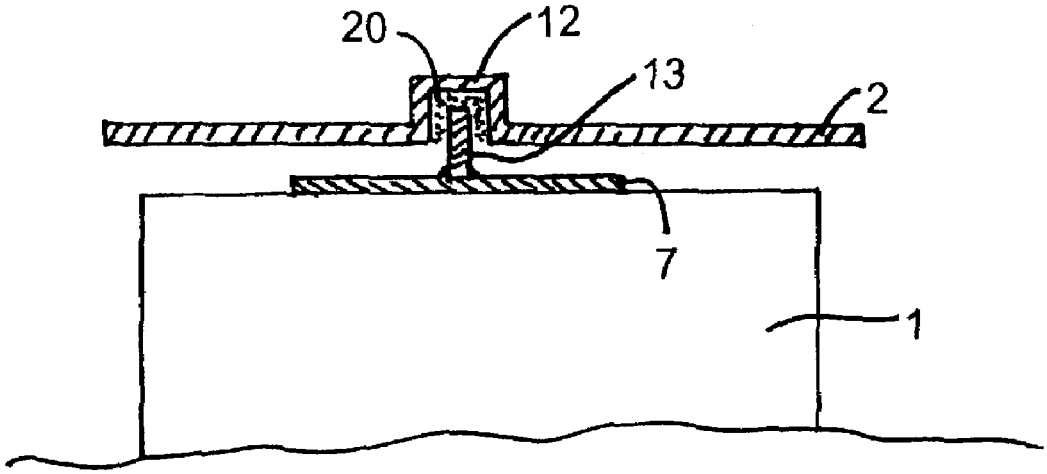

FIG. 4 shows a further type of form-locking connection which simultaneously forms a radial sliding seat between a bead 12 and an intermediate element 13 that permits radial, but not axial, displacement. Again, a swelling mat 20 or mica can be used as an intermediate layer.

Figure 5:
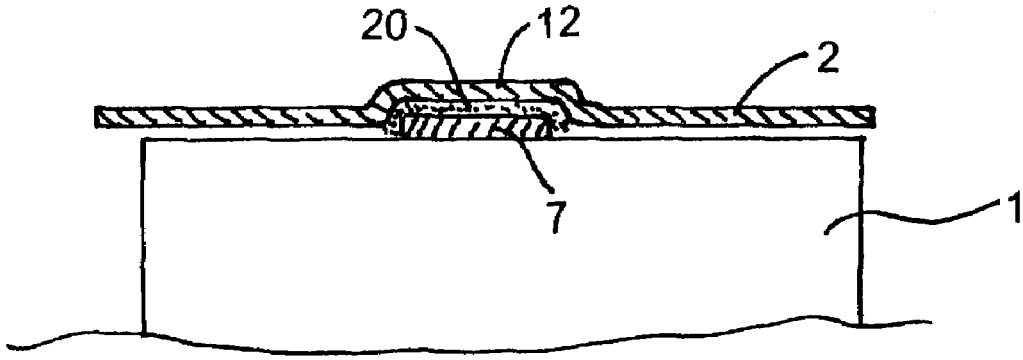

FIG. 5 shows a preferred embodiment having a particularly simple structure in which the inner casing tube 7 is secured directly in a correspondingly shaped external bead 12 on the housing 2, again with the possibility of providing an intermediate layer 20 made of mica or the like. However, it is possible to secure the inner casing tube 7 without the intermediate layer 20.

Figure 6:
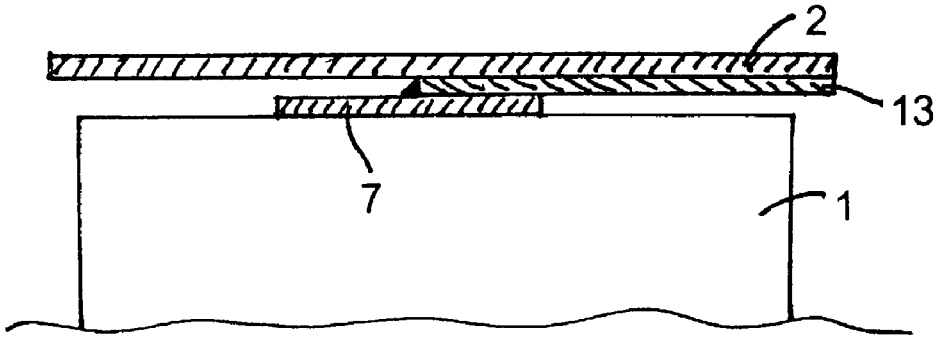

FIG. 6 shows an attachment in which the inner casing tube 7 is suspended from the housing 2 through the use of a tube-like intermediate element 13. This intermediate element 13 can be brazed or welded on. It can also be formed of various non-illustrated segments which are separated through the use of axial slits, providing additional elasticity of the attachment.

Figure 7:
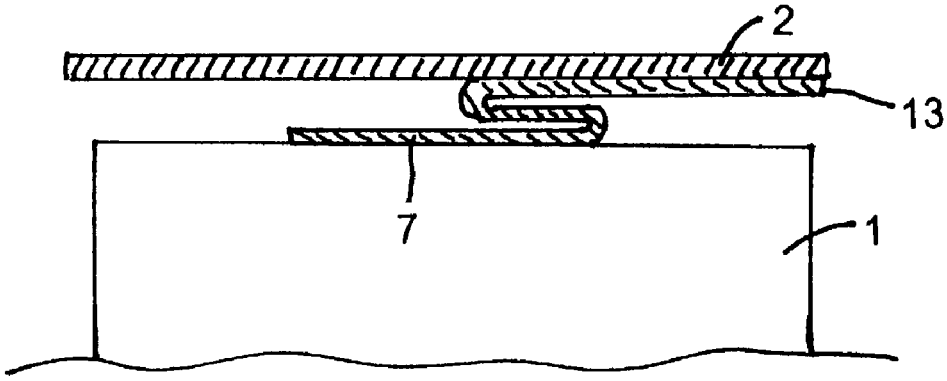

FIG. 7 shows an embodiment similar to FIG. 6. However, the inner casing tube 7 is deformed into an S-shaped cross section so that it simultaneously forms an intermediate element 13 which is attached to the housing 2.

Figure 8:
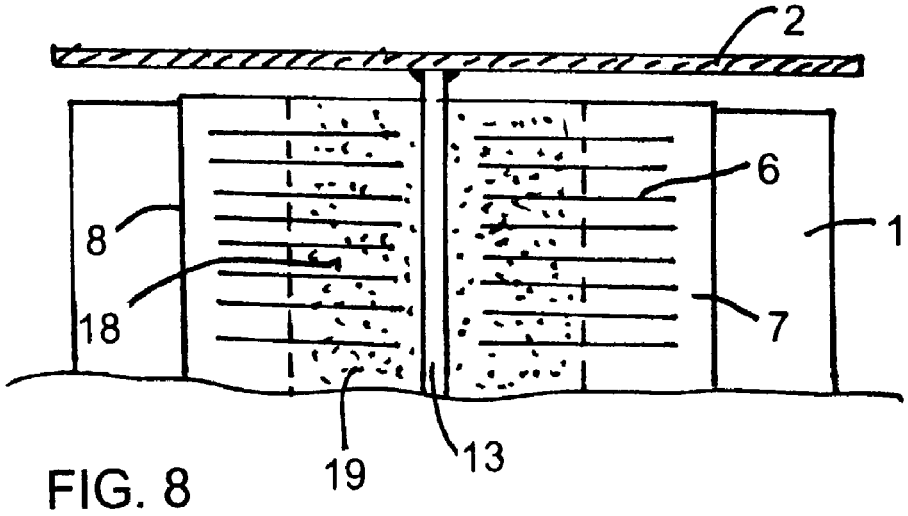

FIG. 8 shows a particularly preferred embodiment of the invention in a diagrammatic side view of a housing 2 with longitudinal slits. In this case, the inner casing tube 7 is provided with axial slits 6 which are approximately symmetrical with respect to an annular intermediate element 13 disposed in the center. However, these slits do not extend entirely as far as the edges 8 of the inner casing tube 7. This structure can be handled more easily during the production process because of the inner casing tube which has flat edges 8, rather than an inner casing tube that has slits extending to the edges. A connection region 19 (indicated by dots) between the inner casing tube 7 and the honeycomb body 1 ends approximately halfway along the length of the slits 6 so that elastic spring elements 18 are produced even when the slits 6 are not continuous. The annular intermediate element 13 can also be made so rigid that the housing 2 essentially moves slightly in the case of thermal stresses between the honeycomb body 1 and the housing 2.

It is thus seen that the intermediate element 13 may be an annular collar extending in circumferential direction, for attaching the inner casing tube 7 to the housing 2. The annular collar 13 may be radially resilient or a radial sliding seat.

Figure 9:
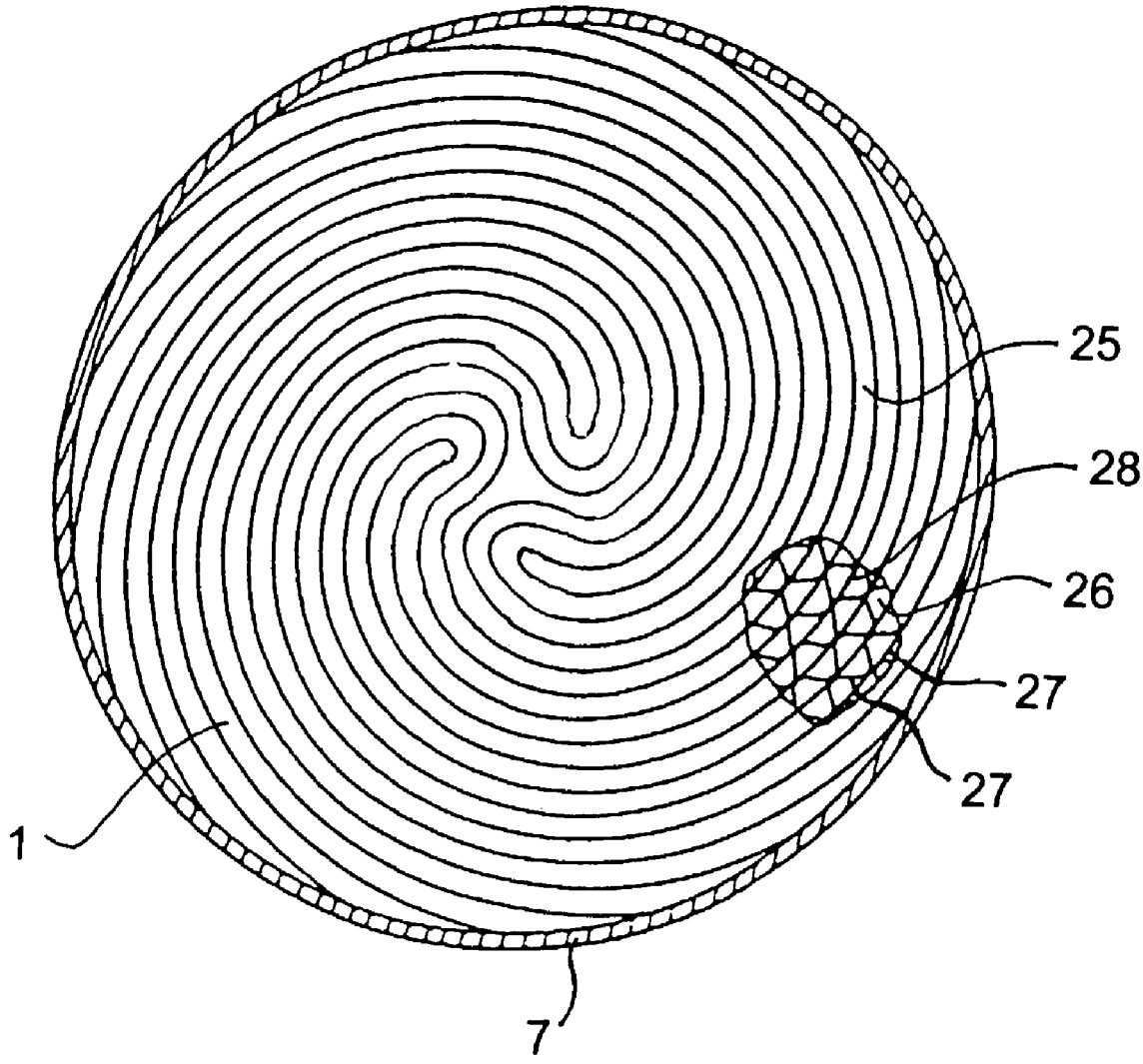
FIG. 9 is a cross-sectional view through a honeycomb body and an inner casing tube.

FIG. 9 is a diagrammatic view of a cross section through a honeycomb body 1 and an inner casing tube 7. The cross section is taken through a region of the inner casing tube 7 which has no slits 6. The honeycomb body 1 has sheet-metal layers 25 which are structured in such a way that they form channels 26 through which an exhaust gas can flow. The channels are formed in this case by stacks of corrugated metal sheets 27 and smooth metal sheets 28. The honeycomb body 1 is subsequently manufactured by intertwining or winding the metal sheets 25. The honeycomb body preferably has a channel density of at least 800 cpsi. The metal sheets 25 have a sheet-metal thickness which is preferably less than 0.025 mm.

The inventive attachment of a honeycomb body in a housing ensures permanent fixing of the honeycomb body, in particular in an exhaust gas system of an internal combustion engine. The temperature differences and pressure fluctuations which occur in this case can be compensated by the attachment according to the invention by virtue of the fact that the radial expansion or shrinkage of the honeycomb body is not impeded to such an extent that service-life-limiting stresses occur between the housing and the honeycomb body.

We claim:

1. An assembly, comprising:

a housing;

a honeycomb body having a given axial length; and an inner casing tube securing said honeycomb body in said housing;

said inner casing tube substantially axially centrally surrounding said honeycomb body and being joined to said honeycomb body in at least one axial connection region;

said inner casing tube having two edges and an overall length substantially smaller than said given axial length, said overall length bounded axially by said edges;

said inner casing tube having a partial region within said axial connection region, said inner casing tube connected to said housing in said partial region; and said inner casing tube having regions acting as radially elastic spring elements, said regions inwardly connected to said honeycomb body but not connected to said housing.

2. The assembly according to claim 1, wherein said housing is a housing of an exhaust system of an internal combustion engine.

3. The assembly according to claim 2, wherein said inner casing tube is joined to said honeycomb body by brazing.

4. The assembly according to claim 1, wherein said inner casing tube is connected to said honeycomb body on the inside in said axial connection region.

5. The assembly according to claim 1, wherein said inner casing tube is attached directly adjacent said honeycomb body on the outside in said axial connection region.

6. The assembly according to claim 1, wherein said spring elements are bounded in circumferential direction by approximately axially extending slits formed in said inner casing tube.

7. The assembly according to claim 6, wherein said slits extend approximately axially from both sides of said partial region.

8. The assembly according to claim 1, wherein said honeycomb body, said inner casing tube and said housing are substantially symmetrical relative to a central cross-sectional plane.

9. The assembly according to claim 6, wherein said slits extend to said edges of said inner casing tube.

10. The assembly according to claim 6, wherein said slits have a width of at least 1 mm.

11. The assembly according to claim 6, wherein said slits have a width of at least 2 mm.

12. The assembly according to claim 6, wherein said slits have a length and have a width varying over said length.

13. The assembly according to claim 6, wherein each of said slits has end regions and a recess at least at one of said end regions.

14. The assembly according to claim 6, wherein at least some of said slits each have at least one transverse slit.

15. The assembly according to claim 1, wherein said honeycomb body has sheet-metal layers structured to form channels through which an exhaust gas can flow.

16. The assembly according to claim 15, wherein said channels having a channel density of at least 800 cpsi.

17. The assembly according to claim 15, wherein said sheet-metal layers have metal sheets with a thickness of less than 0.03 mm.

18. The assembly according to claim 15, wherein said sheet-metal layers have metal sheets with a thickness of less than 0.025 mm.

19. The assembly according to claim 1, wherein said inner casing tube is connected to said housing by at least one welded connection.

20. The assembly according to claim 1, wherein said inner casing tube is secured in said housing by a form-locking connection.

21. The assembly according to claim 1, including an annular collar extending in circumferential direction, said annular collar attaching said inner casing tube to said housing.

22. The assembly according to claim 21, wherein said annular collar is radially resilient.

23. The assembly according to claim 21, wherein said annular collar is a radial sliding seat.

24. The assembly according to claim 1, wherein said honeycomb body is folded into a substantially S-shape as seen in a longitudinal section.

* * * * *